US007175001B2

(12) United States Patent
Jeon

(10) Patent No.: US 7,175,001 B2
(45) Date of Patent: Feb. 13, 2007

(54) APPARATUS FOR DRIVING RAISING AND LOWERING OF LIFT FOR TOWER TYPE STOREHOUSE

(75) Inventor: Woo-gon Jeon, Seoul (KR)

(73) Assignee: EZ Indus Co., Ltd. (KR)

( * ) Notice: Subject to any disclaimer, the term of this patent is extended or adjusted under 35 U.S.C. 154(b) by 0 days.

(21) Appl. No.: 10/515,958

(22) PCT Filed: Nov. 28, 2002

(86) PCT No.: PCT/KR02/02236

§ 371 (c)(1),
(2), (4) Date: Nov. 24, 2004

(87) PCT Pub. No.: WO03/100197

PCT Pub. Date: Dec. 4, 2003

(65) Prior Publication Data

US 2005/0167203 A1 Aug. 4, 2005

(30) Foreign Application Priority Data

May 29, 2002 (KR) ..... 20-2002-0016458

(51) Int. Cl.
*B66B 9/04* (2006.01)
*F01B 15/00* (2006.01)

(52) U.S. Cl. ..... 187/272; 187/273; 92/66; 91/167 R; 91/173

(58) Field of Classification Search ..... 403/230, 403/335, 336, 337, 338; 187/272, 273; 92/61, 92/62, 66; 91/167 R, 173
See application file for complete search history.

(56) References Cited

U.S. PATENT DOCUMENTS 1,779,557 A * 10/1930 Patterson ..... 417/449

(Continued)

FOREIGN PATENT DOCUMENTS

JP 0494390 A * 3/1992

(Continued)

*Primary Examiner*—Kathy Matecki
*Assistant Examiner*—Eric E. Pico
(74) *Attorney, Agent, or Firm*—Cantor Colburn LLP

(57) ABSTRACT

There is provided an apparatus for driving the raising and lowering of a lift for a tower type storehouse so as to supply a force for vertically operating the lift carrying goods to storerooms on every floor of the storehouse, and more particularly to an apparatus for driving the raising and lowering of a lift for a tower type storehouse, in which a plurality of hydraulic cylinder units are connected to each other along a vertical axial line so that the raising and lowering of the lift is achieved by the expansion and contraction of the connected hydraulic cylinder units due to the supply of hydraulic pressure, thereby uniformly supplying the hydraulic pressure to every hydraulic cylinder unit and assuring stability in the raising and lowering of the lift.

3 Claims, 6 Drawing Sheets

U.S. PATENT DOCUMENTS 3,288,036 A * 11/1966 Fisher ..... 92/62
3,477,229 A * 11/1969 Katko ..... 60/394
3,534,664 A * 10/1970 Ulinski ..... 92/145
3,710,690 A * 1/1973 Dye ..... 91/25
3,882,759 A * 5/1975 Formwalt et al. ..... 91/167 R
3,911,790 A * 10/1975 Gaitten ..... 91/167 R
3,956,970 A * 5/1976 Kupiek et al. ..... 91/173
3,968,860 A * 7/1976 Atkey ..... 187/272
4,169,604 A * 10/1979 Heathcott ..... 277/529
4,233,887 A * 11/1980 Stoll ..... 92/169.1
4,575,976 A * 3/1986 McDermott et al. ..... 52/118
4,678,392 A * 7/1987 Capers et al. ..... 404/563
4,751,821 A * 6/1988 Birchard ..... 60/698
4,807,890 A * 2/1989 Gorman et al. ..... 277/346
5,613,667 A * 3/1997 Ho ..... 267/141.1
5,690,462 A * 11/1997 Fan et al. ..... 414/228
6,314,862 B1 * 11/2001 Retterer ..... 92/62
6,554,523 B2 * 4/2003 Aday et al. ..... 403/31
6,796,216 B2 * 9/2004 Kuchheuser ..... 92/168

FOREIGN PATENT DOCUMENTS

JP 05043171 A * 2/1993
KR 2000-0064175 11/2000
KR 2000064175 A * 11/2000

* cited by examiner

APPARATUS FOR DRIVING RAISING AND LOWERING OF LIFT FOR TOWER TYPE STOREHOUSE

BACKGROUND OF THE INVENTION

1. Field of the Invention

The present invention relates to an apparatus for driving the raising and lowering of a lift for a tower type storehouse so as to supply a force for vertically operating the lift carrying goods to storerooms on every floor of the storehouse, and more particularly to an apparatus for driving the raising and lowering of a lift for a tower type storehouse, in which a plurality of hydraulic cylinder units are connected to each other along a vertical axial line so that the raising and lowering of the lift is achieved by the expansion and contraction of the connected hydraulic cylinder units due to the supply of hydraulic pressure, thereby uniformly supplying the hydraulic pressure to every hydraulic cylinder unit and assuring stability in the raising and lowering of the lift.

2. Description of the Related Art

Generally, in tower type storehouses serving also as a parking structure, a tower including storerooms on every floor is built and a lift is constructed so as to be vertically operated to be raised and lowered throughout every floor of the tower, thereby carrying goods loaded on the lift to corresponding floors of the tower. Herein, the lift is raised and lowered by a driving force supplied from a driving apparatus.

In the conventional apparatus for driving the raising and lowering of the lift, a machinery room provided with a driving motor is prepared on the uppermost floor of the tower. A pulley is installed on a rotary axis of the driving motor, and a wire rope is hung on the pulley. One terminal of the wire rope is connected to the lift and the other terminal of the wire rope is connected to a counterweight. Thereby, the lift is vertically operated so that a balance of the lift is maintained by the driving motor-operated wire.

However, since the aforementioned conventional driving apparatus is conceived such that the lift is raised and lowered by a drawing force of the wire rope created by the driving force of the motor, the conventional driving apparatus has several problems, such as instability in the raising and lowering of the lift and enormous power consumption due to a considerable load required to support the total weight of the lift including cars and/or goods, and pallets loaded on the lift, and the risk of an lift-overturning accident.

SUMMARY OF THE INVENTION

Therefore, the present invention has been made in view of the above problems, and it is an object of the present invention to provide an apparatus for driving the raising and lowering of a lift for a tower type storehouse, in which a plurality of hydraulic cylinder units are connected to each other along a vertical axial line so that the raising and lowering of the lift is achieved by the expansion and contraction of the connected hydraulic cylinder units due to the supply of hydraulic pressure, thereby uniformly supplying the hydraulic pressure to every hydraulic cylinder unit and assuring stability in the raising and lowering of the lift.

It is another object of the present invention to provide an apparatus for driving the raising and lowering of a lift for a tower type storehouse, which prevents a buckling effect in which the coaxially connected hydraulic cylinder units are deviated from the vertical axial line, thereby continuously maintaining accuracy in the raising and lowering of the lift.

It is yet another object of the present invention to provide an apparatus for driving the raising and lowering of a lift for a tower type storehouse, in which a cylinder housing and a cylinder rod of every hydraulic cylinder unit are completely airtight, thereby preventing oil leakage and thus degradation of the apparatus.

In accordance with the present invention, the above and other objects can be accomplished by the provision of an apparatus for driving the raising and lowering of a lift for a tower type storehouse comprising a plurality of hydraulic cylinder units, each unit including: a cylinder housing having a housing hydraulic path vertically passing through its central area and a lower flange attached to its bottom surface; and a cylinder rod having a rod hydraulic path vertically passing through its central area so as to be continuous with the housing hydraulic path and an upper flange attached to its top surface so as to correspond to the lower flange of the cylinder housing, wherein the hydraulic cylinder units are connected to each other along a vertical axial line, and the housing hydraulic path of each cylinder housing and the rod hydraulic path of each cylinder rod have the same diameter.

Preferably, vertical guide rails may be respectively installed on both sides of the connected hydraulic cylinder units, and guide shoes moving along the guide rails and guiding the expansion and contraction of the hydraulic cylinder units may be fixedly attached to the outer surfaces of the cylinder housings.

Further, preferably, the apparatus for driving the raising and lowering of a lift for a tower type storehouse further comprises an airtight cap screwed into the top surface of the cylinder housing including: a housing insertion cavity for receiving the cylinder housing, formed on the lower portion of the airtight cap; a vertical through hole for receiving the cylinder rod, formed on the upper portion of the airtight cap; a fixing protrusion formed between the housing insertion cavity and the vertical through hole; and a vibroisolating rubber attached to the top surface of the airtight cap; and airtight rings respectively interposed between the cylinder housing and the airtight cap and between the cylinder rod and the airtight cap.

BRIEF DESCRIPTION OF THE DRAWINGS

The above and other objects, features and other advantages of the present invention will be more clearly understood from the following detailed description taken in conjunction with the accompanying drawings, in which:

FIG. 5*a* is a cross-sectional view of the driving apparatus of the present invention prior to its operation; and FIG. 5*b* is a cross-sectional view of the driving apparatus of the present invention during its operation.

DESCRIPTION OF THE PREFERRED EMBODIMENTS

Now, preferred embodiments of the present invention will be described in detail with reference to the annexed drawings.

Figure 1:
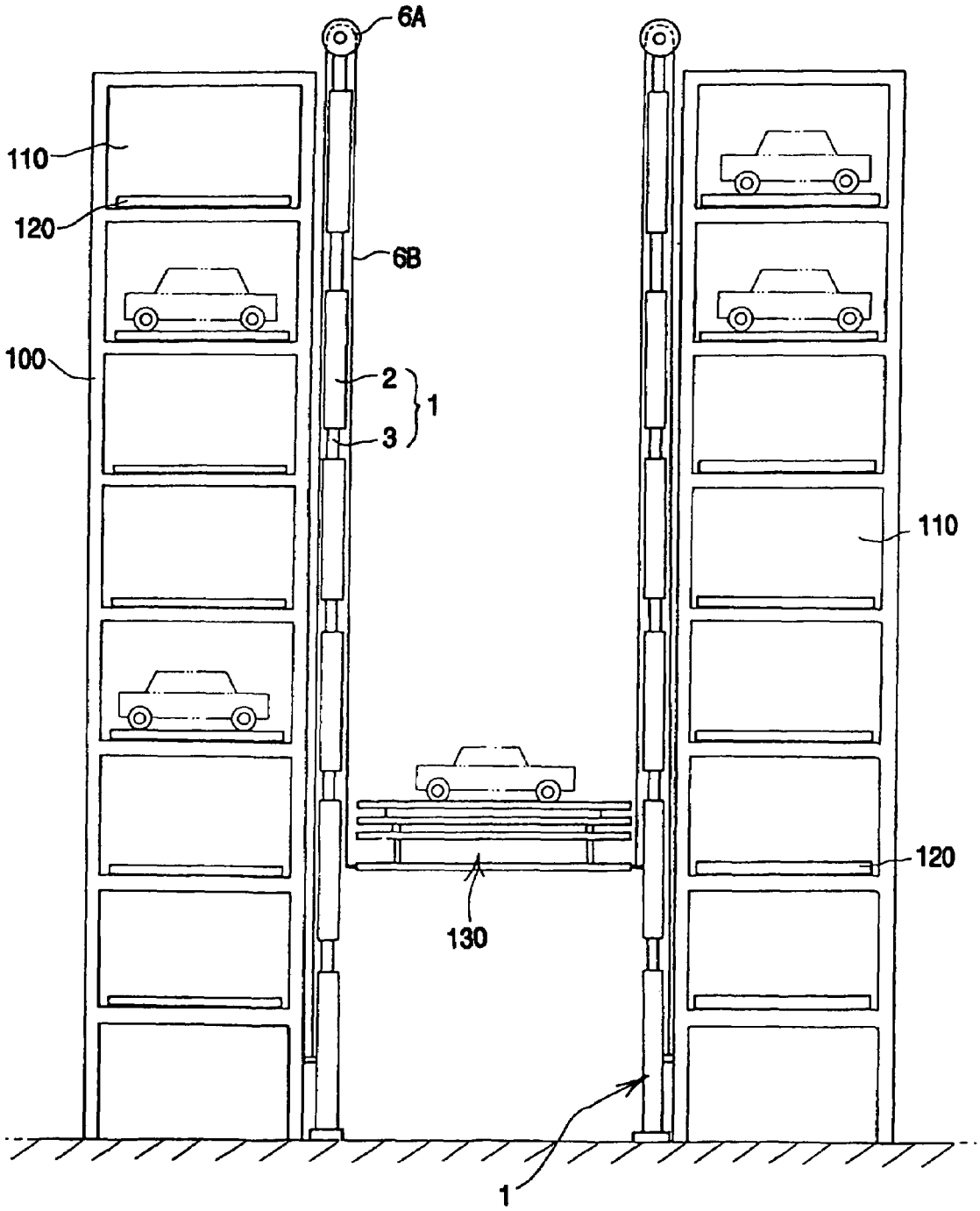
FIG. 1 is a front view of a tower type storehouse employing a driving apparatus in accordance with an embodiment of the present invention.

FIG. 1 is a front view of a tower type storehouse employing an apparatus for driving the raising and lowering of a lift in accordance with an embodiment of the present invention. In the tower type storehouse employing the driving apparatus of the present invention, like conventional tower type storehouses, two towers 100 vertically stand. Storehouses 110 respectively provided with pallets 120 are installed on every floor of the tower 100. A lift 130 is disposed between the two towers 100 so as to be raised and lowered by a driving force supplied from the driving apparatus 1, thereby carrying goods including cars loaded thereon to corresponding floors.

In the above-described tower type storehouse, the driving apparatus 1 comprises a plurality of hydraulic cylinder units 1, which are connected to each other along a vertical axial line, thereby being expanded and contracted by hydraulic pressure so as to supply a force for driving the raising and lowering of the lift 130.

In accordance with the embodiment of the present invention, a chain gear 6A is installed on the uppermost hydraulic cylinder unit 1 and a chain 6B is hung on the chain gear 6A. One end of the chain 6B is fixed to the lowermost hydraulic cylinder 1 or the tower 100, and the other end of the chain 6B is fixed to the lift 130. Thereby, the lift 130 is raised and lowered even by a small force due to the expansion and contraction of the connected hydraulic cylinder units 1. Since the present invention is characterized by the connection of the hydraulic cylinder units 1, the present invention is not limited to the above-described configuration, but may use other configurations that can transfer the driving force by the expansion and contraction of the hydraulic cylinder units 1 to the lift 130.

Figure 2:
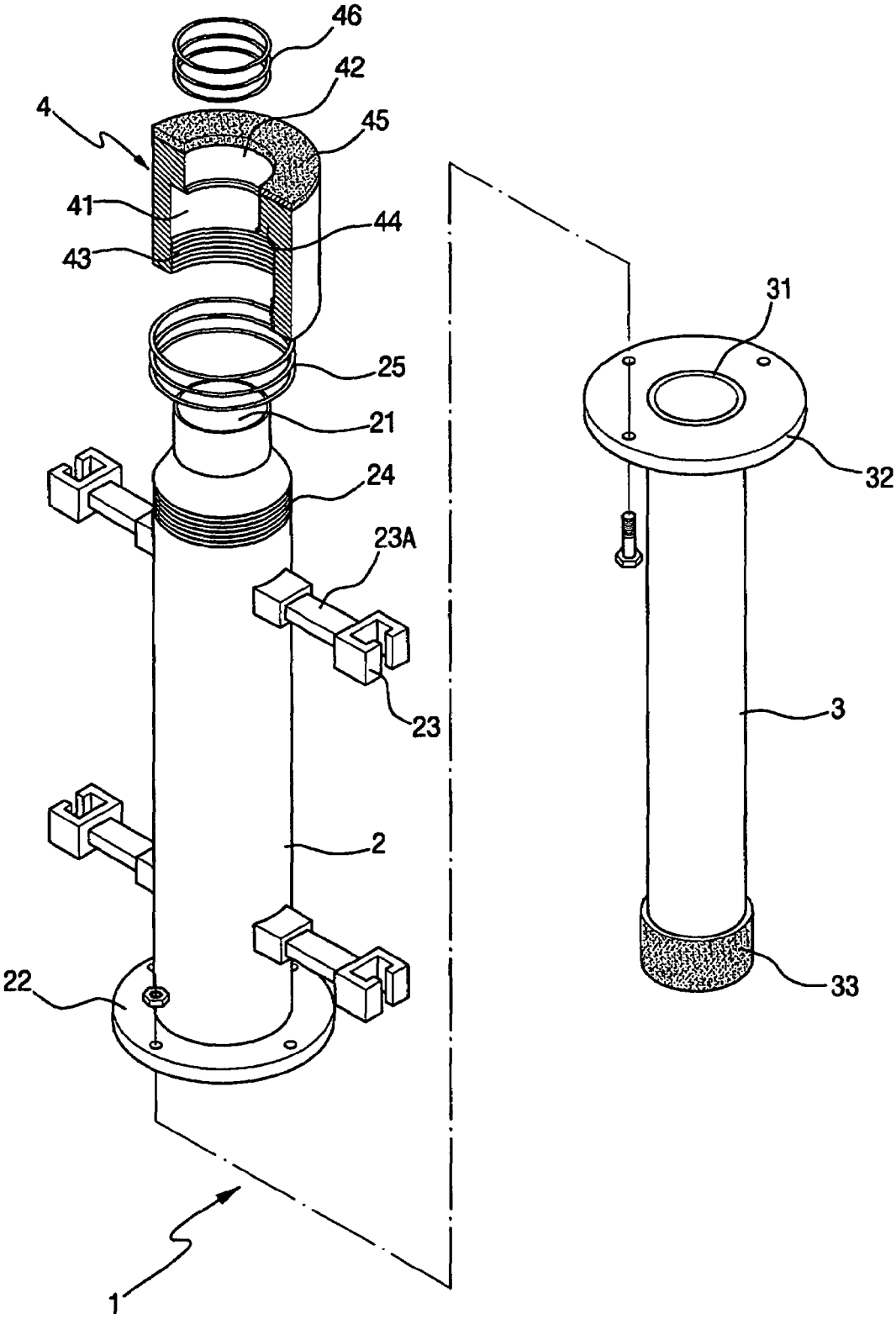
FIG. 2 is an exploded perspective view of essential parts of the driving apparatus in accordance with the present invention.

FIG. 2 is an exploded perspective view of essential parts of the driving apparatus in accordance with the present invention. As shown in FIG. 2, the driving apparatus 1 of the present invention comprises a plurality of the hydraulic cylinder units 1, each unit 1 including a cylinder housing 2 and a cylinder rod 3. The cylinder housing 2 is a comparatively long cylindrical body, and includes a housing hydraulic path 21 vertically passing through the central area of the cylinder housing 2 and a lower flange 22 formed on the bottom surface of the cylinder housing 2.

The cylinder rod 3 is a cylindrical body with a diameter a little smaller than that of the cylinder housing 2, and includes a rod hydraulic path 31 vertically passing through the central area of the cylinder rod 3 so as to be continuous with the housing hydraulic path 31 of the cylinder housing 2, and an upper flange 32 formed on the top surface of the cylinder rod 3 so as to be connected to the lower flange 22 of the cylinder housing 2 by bolts. A tight coupler 33 is attached to the bottom surface of the cylinder rod 3. The tight coupler 33 has the same diameter as an inner diameter of the cylinder housing 2 and is slid along the inner surface of the cylinder housing 2.

Guide rails 5 (in FIG. 5*a*) are respectively installed on both sides of the connected hydraulic cylinder units 1. Herein, the guide rail 5 serves to prevent a buckling effect in which the hydraulic cylinder units 1 are deviated from the vertical axial line, after a plurality of the hydraulic cylinder units 1 are connected to each other along the vertical axial line. A plurality of guide shoes 23 are installed along the outer surface of the cylinder housing 2. The guide shoes 23 contact the guide rails 5 and are slid along the guide rails 5 so as to guide the expansion and contraction of the hydraulic cylinder units 1.

Further, there is provided an airtight cap 4 serving to maintain air-tightness between the cylinder housing 2 and the cylinder rod 3. The airtight cap 4 includes a housing insertion cavity 41 with an opened bottom surface for receiving the cylinder housing 2 and at vertical through hole 42 formed on the upper surface of the housing insertion cavity 41 for receiving the cylinder rod 3. Since the cylinder rod 3 is inserted into the vertical through hole 42, the vertical through hole 42 has the same diameter as an outer diameter of the cylinder rod 3.

A vibroisolating rubber 45 with the same shape as the plan view of the cylinder rod 3 is attached to the upper surface of the airtight cap 4 and serves to alleviate impact on the upper flange 32 formed on the upper surface of the cylinder rod 3. In order to prevent the cylinder rod 3 from being separated from the cylinder housing 2, a fixing protrusion 44 is formed between the housing insertion cavity 41 and the vertical through hole 42.

The airtight cap 4 is connected to the cylinder housing 2 by engaging an internal spiral thread 43 formed on the inner surface of the airtight cap 4 with an external spiral thread 24 formed on the outer surface of the cylinder housing 2.

Airtight rings 25 and 46 are respectively interposed between the airtight cap 4 and the cylinder housing 2 and between the airtight cap 4 and the cylinder rod 3, that is, on the housing insertion cavity 41 and the vertical through hole 42, thereby doubly maintaining the air-tightness between the cylinder housing 2 and the cylinder rod 3.

Figure 3:
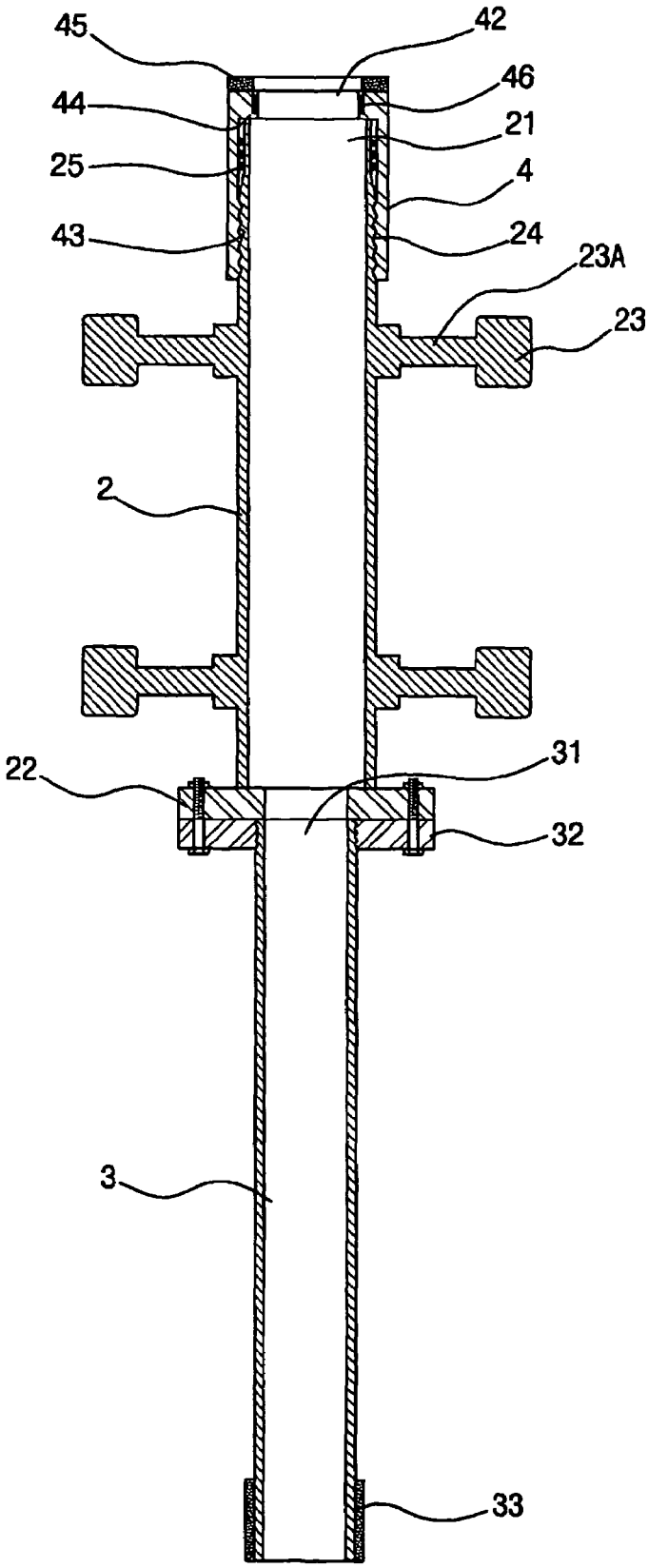
FIG. 3 is an assembled cross-sectional view of the driving apparatus of FIG. 2.

FIG. 3 is a cross-sectional view of the assembled driving apparatus of FIG. 2. As shown in FIG. 3, the upper flange 32 of the cylinder rod 3 is bolt-connected to the lower flange 22 of the cylinder housing 2, the upper portion of the cylinder housing 2 is inserted into the housing insertion cavity 41 of the airtight cap 4, and connected thereto by engaging the internal spiral thread 43 of the airtight cap 4 with the outer spiral thread 24 of the cylinder housing 2. Herein, the airtight ring 25 is interposed between the airtight cap 4 and the cylinder housing 2.

The cylinder rod 3 is inserted into the vertical through hole 42 of the airtight cap 4. The tight coupler 33 attached to the bottom surface of the cylinder rod 3 is fixed to the fixing protrusion 44 of the airtight cap 4, thereby preventing the cylinder rod 3 from being separated from the cylinder housing 2. Then, the tight coupler 33 disposed within the cylinder housing 2 serves to tightly support the side surface of the cylinder rod 3 so as to vertically move the cylinder rod 3 in the cylinder housing 2 without shaking or vibration. The airtight ring 46 is interposed between the airtight cap 4 and the cylinder rod 3.

Figure 4:
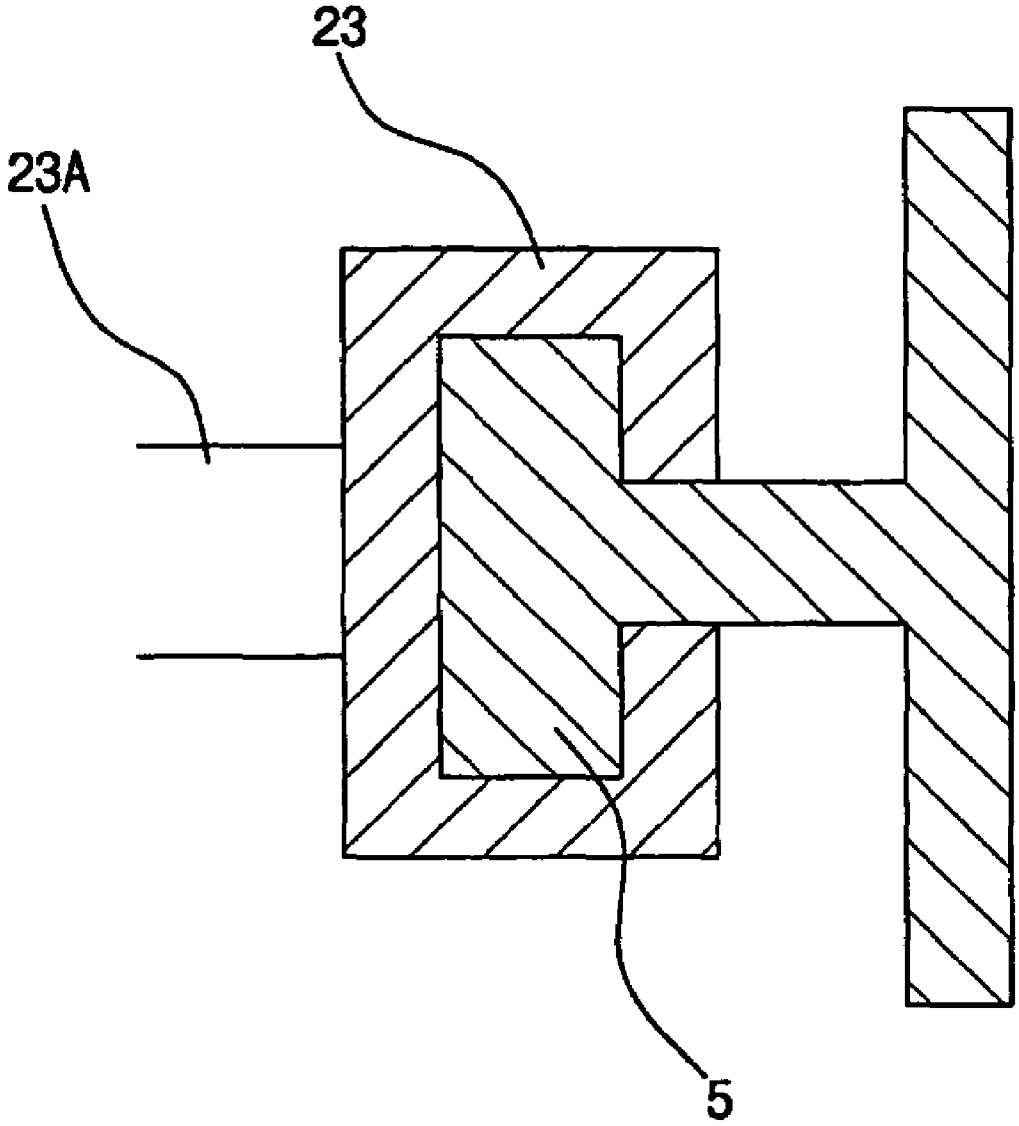
FIG. 4 is a cross-sectional view of a guide shoe of the driving apparatus in accordance with the present invention.

The guide shoes 23 formed on the outer surface of the cylinder housing 2 are fixed to the cylinder housing 2 by supporters 23A. As shown in FIG. 4, the guide shoe 23 is engaged with the guide rail 5 installed on the both sides of the connected hydraulic cylinder units 1 so that the guide shoe 23 is slid along the guide rail 5, thereby preventing the guide shoe 23 from being separated from the guide rail 5.

Figure 5A:
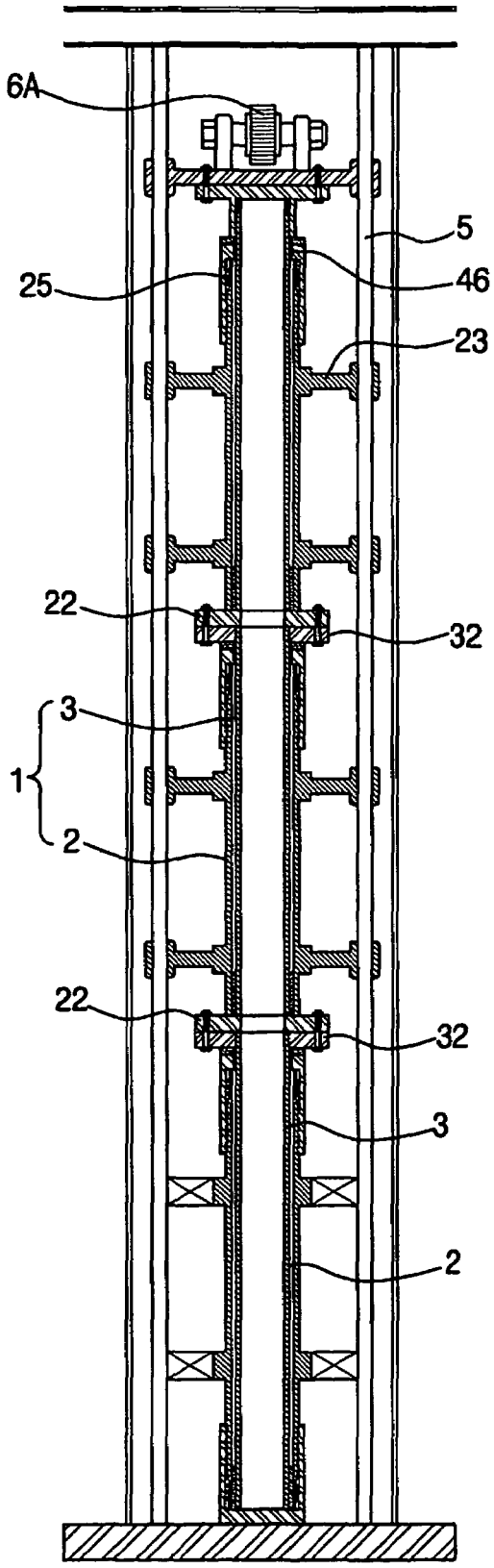
FIGS. 5*a* and 5*b* show an operation of the assembled driving apparatus in accordance with the present invention, and specifically.
Figure 5B:
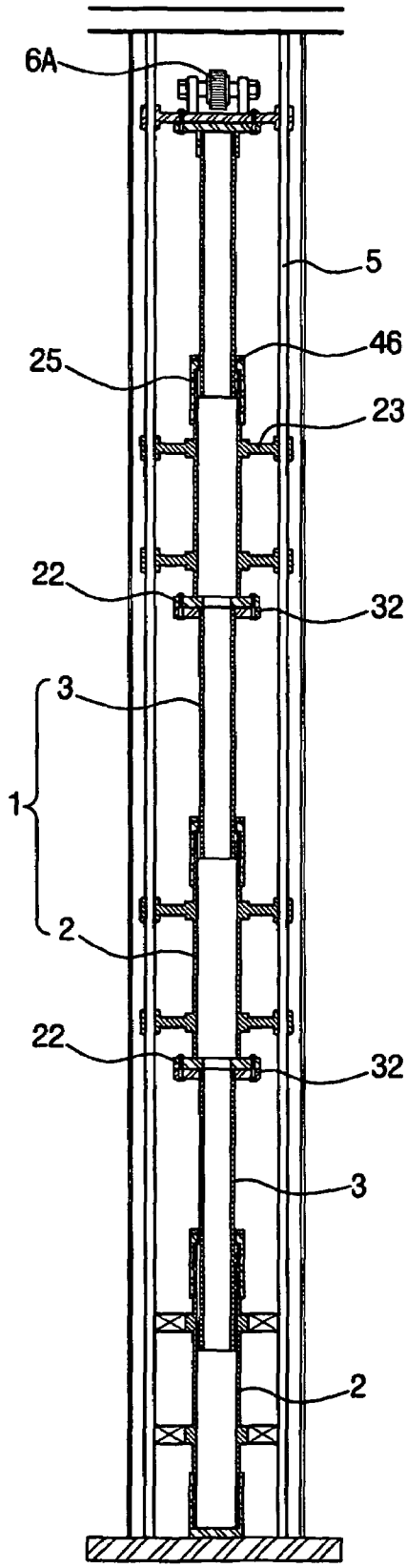

FIGS. 5*a* and 5*b* show an operation of the assembled driving apparatus in accordance with the present invention. FIG. 5*a* is a cross-sectional view of the driving apparatus of the present invention prior to its operation.

As described above, a plurality of the hydraulic cylinder units 1 are prepared and then connected along the vertical axial line by the flange connection. Herein, the uppermost flange 6 having the chain gear 6A connected to the lift 130 (in FIG. 1) via a chain is installed on the upper surface of the uppermost cylinder rod 3, and the airtight cap 4 for maintaining the air-tightness between the cylinder housing 2 and the cylinder rod 3 is installed on the bottom surface of the lowermost cylinder housing 2.

In each hydraulic cylinder unit 1 obtained by the flange connection between the cylinder housing 2 and the cylinder rod 3, the housing hydraulic path 21 and the rod hydraulic path 31 have the same diameter.

Before the operation of the driving apparatus 1, as shown in FIG. 5*a*, the vertically connected hydraulic cylinder units 1 are in a contracted condition. That is, the cylinder rod 3 is fully inserted into the cylinder housing 2 of each hydraulic cylinder unit 1. At this time, the hydraulic paths of each cylinder rods 3 with the same diameter are connected to each other.

When a hydraulic pressure is supplied to the bottom portion of the vertically connected hydraulic cylinder units 1, the supplied hydraulic pressure passes through the rod hydraulic paths 31 of the each cylinder rods 3 and reaches the uppermost cylinder rod 3. Then, the hydraulic cylinder units 1 are successively expanded. Herein, since the rod hydraulic paths 31 of each cylinder rods 3 have the same diameter, the hydraulic pressure is uniformly supplied to the every cylinder rod 3 without fluctuations in the pressure. As shown in FIG. 5*b*, the hydraulic cylinder units 1 are successively expanded, thereby achieving the raising of the lift 130 (in FIG. 1).

Also, in the lowering of the lift 130, since the rod hydraulic paths 31 of each cylinder rods 3 and the housing hydraulic paths 21 of each cylinder housings 2 have the same diameter, the hydraulic pressure is uniformly lowered in every cylinder housing 2 and cylinder rod 3 without fluctuations in the pressure, thereby achieving the uniform contraction of the hydraulic cylinder units 1 and the lowering of the lift 130 (in FIG. 1).

As described above, during the raising and lowering of the lift 130, the guide shoes 23 of the cylinder housings 2 are slid along the guide rails 5 so as to guide the expansion and contraction of the hydraulic cylinder units 1. Thereby, the buckling effect in which the hydraulic cylinder units 1 are deviated from the vertical axial line can be prevented. Due to doubly maintaining the air-tightness between the cylinder housings 2 and the cylinder rods 3 by the airtight cap 4 and the airtight rings 25 and 46, oil leakage from the cylinder housings 2 and the cylinder rods 3 can be prevented.

As apparent from the above description, the present invention provides an apparatus for driving the raising and lowering of a lift for a tower type storehouse, in which a plurality of hydraulic cylinder units are connected to each other along a vertical axial line so that the raising and lowering of the lift is achieved by the expansion and contraction of the connected hydraulic cylinder units due to the supply of hydraulic pressure, thereby uniformly supplying the hydraulic pressure to every hydraulic cylinder unit, effectively supporting the total weight of the lift including cars and/or goods, and pallets loaded on the lift, and assuring stability in the raising and lowering of the lift.

And, the apparatus for driving the raising and lowering of a lift for a tower type storehouse in accordance with the present invention prevents a buckling effect in which the coaxially connected hydraulic cylinder units are deviated from the vertical axial line, thereby continuously maintaining accuracy in the raising and lowering of the lift.

Further, since the air-tightness between the cylinder housing and the cylinder rod of each hydraulic cylinder unit is completely maintained, the apparatus for driving the raising and lowering of a lift for a tower type storehouse in accordance with the present invention prevents oil leakage and thus degradation of the apparatus.

Moreover, since the hydraulic cylinder units with the same dimension and configuration are connected to each other so as to form one unit, the apparatus for driving the raising and lowering of a lift for a tower type storehouse in accordance with the present invention is simply installed and maintained.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. Apparatus for driving the raising and lowering of a lift for a tower type storehouse comprising:

a plurality of hydraulic cylinder units, each unit including:

a cylinder housing having a housing hydraulic path vertically passing through its central area and a lower flange attached to its bottom surface; and a cylinder rod having a rod hydraulic path vertically passing through its central area so as to be continuous with the housing hydraulic path and an upper flange attached to its top surface so as to correspond to the lower flange of the cylinder housing, wherein the hydraulic cylinder units are connected to each other along a vertical axial line, and the housing hydraulic path of each cylinder housing have the same diameter and the rod hydraulic path of each cylinder rod have the same diameter.

2. The apparatus for driving the raising and lowering of a lift for a tower type storehouse as set forth in claim 1, wherein vertical guide rails are respectively installed on both sides of the connected hydraulic cylinder units, and guide shoes moving along the guide rails and guiding the expansion and contraction of the hydraulic cylinder units are fixedly attached to the outer surfaces of the cylinder housings.

3. The apparatus for driving the raising and lowering of a lift for a tower type storehouse as set forth in claim 1, further comprising:

an airtight cap screwed into the top surface of the cylinder housing including:

a housing insertion cavity for receiving the cylinder housing, formed on the lower portion of the airtight cap;

a vertical through hole for receiving the cylinder rod, formed on the upper portion of the airtight cap;

a fixing protrusion formed between the housing insertion cavity and the vertical through hole; and a vibroisolating rubber attached to the top surface of the airtight cap; and airtight rings respectively interposed between the cylinder housing and the airtight cap and between the cylinder rod and the airtight cap.

* * * * *